US010947907B2

(12) United States Patent
Shipp et al.

(10) Patent No.: US 10,947,907 B2
(45) Date of Patent: Mar. 16, 2021

(54) VARIABLE ENGINE BRAKING FOR THERMAL MANAGEMENT

(71) Applicant: Cummins Inc., Columbus, IN (US)

(72) Inventors: Timothy Shipp, Seymour, IN (US); David Langenderfer, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/700,317

(22) Filed: Dec. 2, 2019

(65) Prior Publication Data

US 2020/0102896 A1 Apr. 2, 2020

Related U.S. Application Data

(63) Continuation of application No. PCT/US2017/039053, filed on Jun. 23, 2017.

(51) Int. Cl.
*F02D 13/04* (2006.01)
*F02D 13/02* (2006.01)

(52) U.S. Cl.
CPC ..... *F02D 13/0249* (2013.01); *F02D 13/04* (2013.01)

(58) Field of Classification Search
CPC ..... F02D 13/0249; F02D 13/04; F02D 13/06; F01L 1/047; F01L 1/181; F01L 1/344; F01L 1/34413; F01L 2001/0473; F01L 2305/00
USPC ..... 123/320, 321, 322, 323, 345, 346, 347, 123/348, 90.11, 90.15, 90.16, 90.17
See application file for complete search history.

(56) References Cited

U.S. PATENT DOCUMENTS

| | | | | |
|---|---|---|---|---|
| 5,615,653 | A | 4/1997 | Faletti et al. | |
| 5,928,083 | A | 7/1999 | Monahan et al. | |
| 6,170,474 | B1 * | 1/2001 | Israel | F02D 13/04 123/568.14 |
| 6,550,464 | B1 | 4/2003 | Brackney | |
| 6,594,990 | B2 | 7/2003 | Kuenstler et al. | |
| 6,948,310 | B2 | 9/2005 | Roberts, Jr. et al. | |
| 7,162,996 | B2 | 1/2007 | Yang | |
| 7,565,896 | B1 | 7/2009 | Yang | |
| 7,712,449 | B1 | 5/2010 | Schwoerer | |
| 7,954,465 | B2 | 6/2011 | Huang | |

(Continued)

FOREIGN PATENT DOCUMENTS

| | | |
|---|---|---|
| WO | 2007097943 | 8/2007 |
| WO | 2015002777 | 1/2015 |

OTHER PUBLICATIONS

Search Report and Written Opinion, PCT Appln. No. PCT/US17/039053, 13 pgs, dated Sep. 8, 2017.

*Primary Examiner* — Hai H Huynh
(74) *Attorney, Agent, or Firm* — Taft Stettinius & Hollister LLLP

(57) ABSTRACT

An internal combustion engine system includes an engine with a plurality of pistons housed in respective ones of a plurality of cylinders, an air intake system to provide air to the plurality of cylinders through respective ones of a plurality of intake valves, an exhaust system to release exhaust gas from the plurality of cylinders through respective one of a plurality of exhaust valves, an aftertreatment system to treat exhaust emission from the engine, and a controller coupled to at least one sensor and configured to control a variable valve actuation mechanism to provide variable engine braking for thermal management.

20 Claims, 5 Drawing Sheets

(56) References Cited

U.S. PATENT DOCUMENTS

| | | | | |
|---|---|---|---|---|
| 9,616,743 | B1 | 4/2017 | Mays et al. | |
| 2005/0172617 | A1 | 8/2005 | Persson | |
| 2008/0041336 | A1 | 2/2008 | Gibson et al. | |
| 2011/0100324 | A1 | 5/2011 | Xin | |
| 2014/0052344 | A1 | 2/2014 | Tsuda et al. | |
| 2015/0198105 | A1 | 7/2015 | Marlett et al. | |
| 2016/0026187 | A1 | 1/2016 | Alam et al. | |
| 2016/0054735 | A1 | 2/2016 | Switkes | |
| 2020/0208547 | A1* | 7/2020 | Cecil | F01L 1/185 |

* cited by examiner

VARIABLE ENGINE BRAKING FOR THERMAL MANAGEMENT

CROSS-REFERENCE TO RELATED APPLICATIONS

The present application is a continuation of International Patent Application No. PCT/US17/39053 filed on Jun. 23, 2017, which is incorporated herein by reference in its entirety for all purposes.

BACKGROUND

The present invention relates to operation of an internal combustion engine system, and more particularly, but not exclusively, relates to using variable compression release braking for thermal management.

Various aftertreatment subsystems have been developed to control exhaust emissions from internal combustion engines. The performance of the engine and its aftertreatment subsystems often varies with their operating temperatures, which has led to the development of various thermal management systems. Thermal management of the aftertreatment system and/or intake flow to an internal combustion engine can provide operational benefits such as more efficient combustion processes and more effective aftertreatment device operations.

While turbochargers with variable geometry (VG) inlets have been used to increase exhaust temperatures, VG turbochargers are more costly than wastegated turbochargers. Exhaust heaters are also expensive and require a generator to create energy to run the heater. Exhaust throttles are costly and have reliability concerns. Other strategies such as hydrocarbon (HC) dosing, cylinder deactivation, and early exhaust valve opening have also been used for thermal management of aftertreatment systems but could be more effective. Unfortunately, these systems can require multiple additional components to implement and therefore increase the cost and complexity of the system. Thus, there is a continuing demand for further contributions in this area of technology.

SUMMARY

Certain embodiments of the present application includes unique systems, methods and apparatus to regulate operation of an internal combustion engine using an engine braking system that is modulated or controlled to gradually increase and/or decrease engine braking power to provide thermal management. Other embodiments include unique apparatus, devices, systems, and methods involving the control of an internal combustion engine system via an engine braking system to meet one or more of an engine braking request, a vehicle or engine speed request, and a thermal management condition.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION OF REPRESENTATIVE EMBODIMENTS

Figure 1:
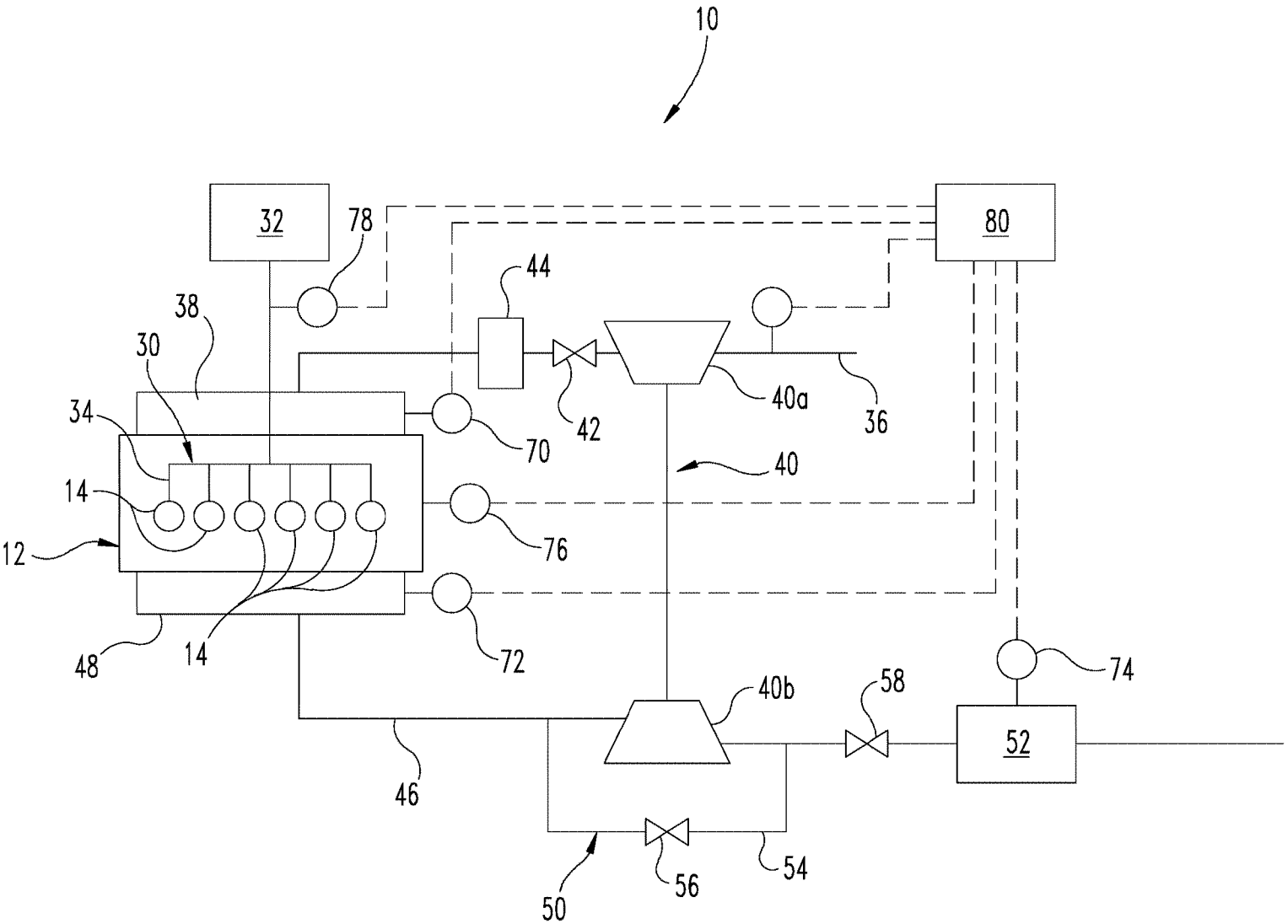
FIG. 1 is a schematic view of one embodiment of an internal combustion engine system operable to provide compression release braking.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein are contemplated as would normally occur to one skilled in the art to which the invention relates.

With reference to FIG. 1, an internal combustion engine system 10 includes a four-stroke internal combustion engine 12. FIG. 1 illustrates an embodiment where the engine 12 is a diesel engine, but any engine type is contemplated, including compression ignition, spark-ignition, and combinations of these. The engine 12 can include a plurality of cylinders 14. FIG. 1 illustrates the plurality of cylinders 14 in an arrangement that includes six cylinders 14 in an in-line arrangement for illustration purposes only. Any number of cylinders and any arrangement of the cylinders suitable for use in an internal combustion engine can be utilized. The number of cylinders 14 that can be used can range from one cylinder to eighteen or more. Furthermore, the following description at times will be in reference to one of the cylinders 14. It is to be realized that corresponding features in reference to the cylinder 14 described in FIG. 2 and at other locations herein can be present for all or a subset of the other cylinders 14 of engine 12.

Figure 2:
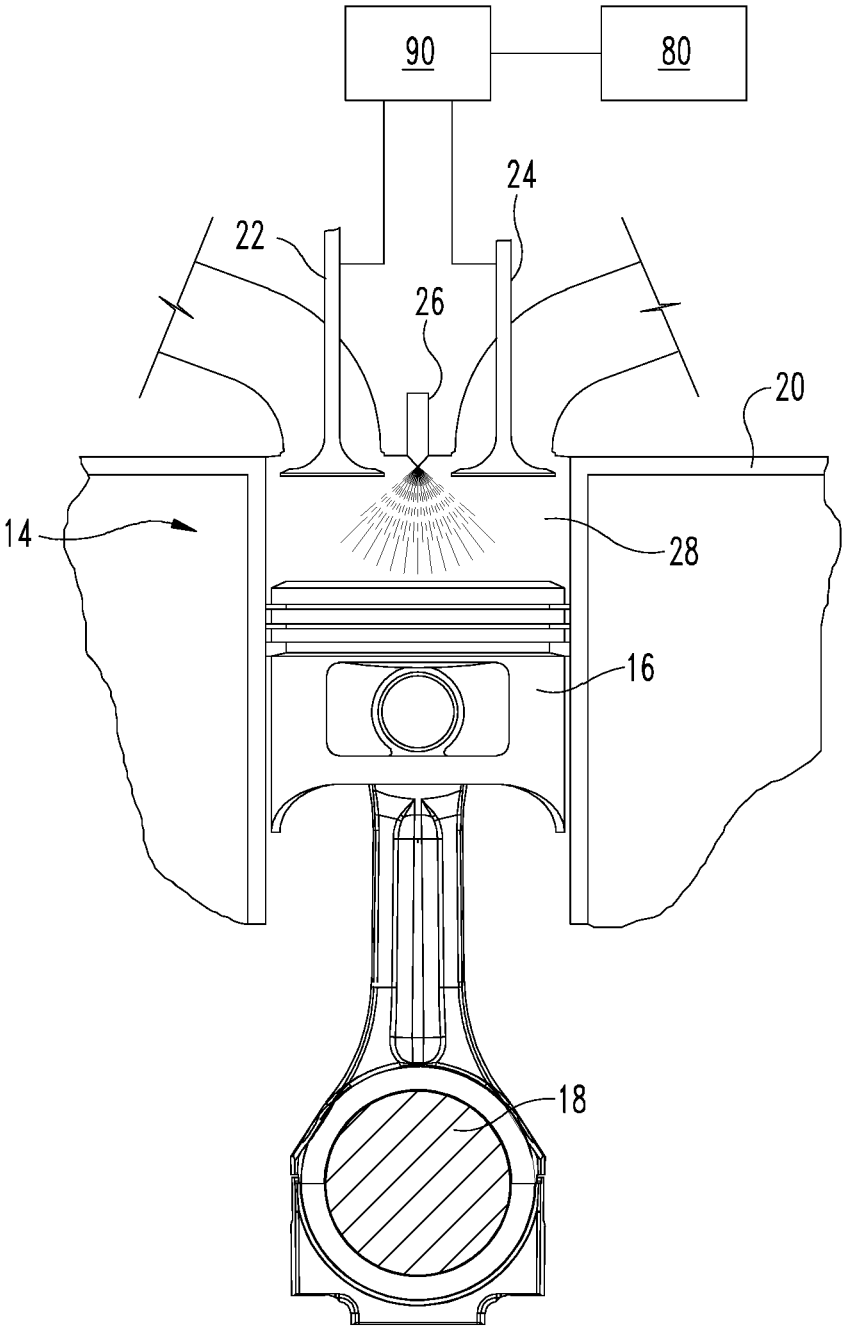
FIG. 2 is a diagrammatic and schematic view of one embodiment of a cylinder of the internal combustion engine system of FIG. 1 and a schematic of a variable valve actuation mechanism.

As shown in FIG. 2, the cylinder 14 houses a piston 16 that is operably attached to a crankshaft 18 that is rotated by reciprocal movement of piston 16 in a combustion chamber 28 of the cylinder 14. Within a cylinder head 20 of the cylinder 14, there is at least one intake valve 22, at least one exhaust valve 24, and a fuel injector 26 that provides fuel to the combustion chamber 28 formed by cylinder 14 between the piston 16 and the cylinder head 20. In other embodiments, fuel can be provided to combustion chamber 28 by port injection, or by injection in the intake system, upstream of combustion chamber 28.

The term "four-stroke" herein means the following four strokes—intake, compression, power, and exhaust—that the piston 16 completes during two separate revolutions of the engine's crankshaft 18. A stroke begins either at a top dead center (TDC) when the piston 16 is at the top of cylinder head 20 of the cylinder 14, or at a bottom dead center (BDC), when the piston 16 has reached its lowest point in the cylinder 14.

During the intake stroke, the piston 16 descends away from cylinder head 20 of the cylinder 14 to a bottom (not shown) of the cylinder, thereby reducing the pressure in the combustion chamber 28 of the cylinder 14. In the instance where the engine 12 is a diesel engine, a combustion charge is created in the combustion chamber 28 by an intake of air through the intake valve 22 when the intake valve 22 is opened.

The fuel from the fuel injector 26 is supplied by a high pressure common-rail system 30 (FIG. 1) that is connected to the fuel tank 32. Fuel from the fuel tank 32 is suctioned by a fuel pump (not shown) and fed to the common-rail fuel system 30. The fuel fed from the fuel pump is accumulated in the common-rail fuel system 30, and the accumulated fuel is supplied to the fuel injector 26 of each cylinder 14 through a fuel line 34. The accumulated fuel in common rail system can be pressurized to boost and control the fuel pressure of the fuel delivered to combustion chamber 28 of each cylinder 14.

During the compression stroke in a non-engine braking mode of operation, both the intake valve 22 and the exhaust valve 24 are closed. The piston 16 returns toward TDC and fuel is injected near TDC in the compressed air in a main injection event, and the compressed fuel-air mixture ignites in the combustion chamber 28 after a short delay. In the instance where the engine 12 is a diesel engine, this results in the combustion charge being ignited. The ignition of the air and fuel causes a rapid increase in pressure in the combustion chamber 28, which is applied to the piston 16 during its power stroke toward the BDC. Combustion phasing in combustion chamber 28 is calibrated so that the increase in pressure in combustion chamber 28 pushes piston 16, providing a net positive in the force/work/power of piston 16.

During the exhaust stroke, the piston 16 is returned toward TDC while the exhaust valve 24 is open. This action discharges the burnt products of the combustion of the fuel in the combustion chamber 28 and expels the spent fuel-air mixture (exhaust gas) out through the exhaust valve 24.

The intake air flows through an intake passage 36 and intake manifold 38 before reaching the intake valve 22. The intake passage 36 may be connected to a compressor 40*a* of a turbocharger 40 and an optional intake air throttle 42. The intake air can be purified by an air cleaner (not shown), compressed by the compressor 40*a* and then aspirated into the combustion chamber 28 through the intake air throttle 42. The intake air throttle 42 can be controlled to influence the air flow into the cylinder.

The intake passage 36 can be further provided with a cooler 44 that is provided downstream of the compressor 40*a*. In one example, the cooler 44 can be a charge air cooler (CAC). In this example, the compressor 40*a* can increase the temperature and pressure of the intake air, while the CAC 44 can increase a charge density and provide more air to the cylinders. In another example, the cooler 44 can be a low temperature aftercooler (LTA). The CAC 44 uses air as the cooling media, while the LTA uses coolant as the cooling media.

The exhaust gas flows out from the combustion chamber 28 into an exhaust passage 46 from an exhaust manifold 48 that connects the cylinders 14 to exhaust passage 46. The exhaust passage 46 is connected to a turbine 40*b* and a wastegate 50 of the turbocharger 40 and then into an aftertreatment system 52. The exhaust gas that is discharged from the combustion chamber 28 drives the turbine 40*b* to rotate. The wastegate 50 is a device that enables part of the exhaust gas to by-pass the turbine 40*b* through a passageway 54. Less exhaust gas energy is thereby available to the turbine 40*b*, leading to less power transfer to the compressor 40*a*. Typically, this leads to reduced intake air pressure rise across the compressor 40*a* and lower intake air density/flow. The wastegate 50 can include a control valve 56 that can be an open/closed (two position) type of valve, or a full authority valve allowing control over the amount of by-pass flow, or anything between. The exhaust passage 46 can further or alternatively include an exhaust throttle 58 for adjusting the flow of the exhaust gas through the exhaust passage 46. The exhaust gas, which can be a combination of by-passed and turbine flow, then enters the aftertreatment system 52.

Optionally, a part of the exhaust gas can be recirculated into the intake system via an EGR passage (not shown.) The EGR passage can be connected the exhaust passage upstream of the turbine 40*b* to the intake passage 36 downstream of the intake air throttle 42. Alternatively or additionally, a low pressure EGR system (not shown) can be provided downstream of turbine 40*b* and upstream of compressor 40*a*. An EGR valve can be provided for regulating the EGR flow through the EGR passage. The EGR passage can be further provided with an EGR cooler and a bypass around the EGR cooler.

The aftertreatment system 52 may include one or more devices useful for handling and/or removing material from exhaust gas that may be harmful constituents, including carbon monoxide, nitric oxide, nitrogen dioxide, hydrocarbons, and/or soot in the exhaust gas. In some examples, the aftertreatment system 52 can include at least one of a catalytic device and a particulate matter filter. The catalytic device can be a diesel oxidation catalyst (DOC) device, ammonia oxidation (AMOX) catalyst device, a selective catalytic reduction (SCR) device, three-way catalyst (TWC), lean NOX trap (LNT) etc. The reduction catalyst can include any suitable reduction catalysts, for example, a urea selective reduction catalyst. The particulate matter filter can be a diesel particulate filter (DPF), a partial flow particulate filter (PFF), etc. A PFF functions to capture the particulate matter in a portion of the flow; in contrast the entire exhaust gas volume passes through the particulate filter.

The arrangement of the components in the aftertreatment system 52 can be any arrangement that is suitable for use with the engine 12. For example, in one embodiment, a DOC and a DPF are provided upstream of a SCR device. In one example, a reductant delivery device is provided between the DPF and the SCR device for injecting a reductant into the exhaust gas upstream of SCR device. The reductant can be urea, diesel exhaust fluid, or any suitable reductant injected in liquid and/or gaseous form.

A controller 80 is provided to receive data as input from various sensors, and send command signals as output to various actuators. Some of the various sensors and actuators that may be employed are described in detail below. The controller 80 can include, for example, a processor, a memory, a clock, and an input/output (I/O) interface.

The system 10 includes various sensors such as an intake manifold pressure/temperature sensor 70, an exhaust manifold pressure/temperature sensor 72, one or more aftertreatment sensors 74 (such as a differential pressure sensor, temperature sensor(s), pressure sensor(s), constituent sensor(s)), engine sensors 76 (which can detect the air/fuel ratio of the air/fuel mixture supplied to the combustion chamber, a crank angle, the rotation speed of the crankshaft, etc.), and a fuel sensor 78 to detect the fuel pressure and/or other properties of the fuel, common rail 38 and/or fuel injector 26. Any other sensors known in the art for an engine system are also contemplated.

System 10 can also include various actuators for opening and closing the intake valves 22, for opening and closing the exhaust valves 24, for injecting fuel from the fuel injector 26, for opening and closing the wastegate valve 56, for the intake air throttle 42, and/or for the exhaust throttle 58. The actuators are not illustrated in FIG. 1, but one skilled in the art would know how to implement the mechanism needed for each of the components to perform the intended function. Furthermore, in one embodiment, the actuators for opening and closing the intake and exhaust valves 22, 24 is a variable valve actuation (VVA) system 90.

Figure 3:
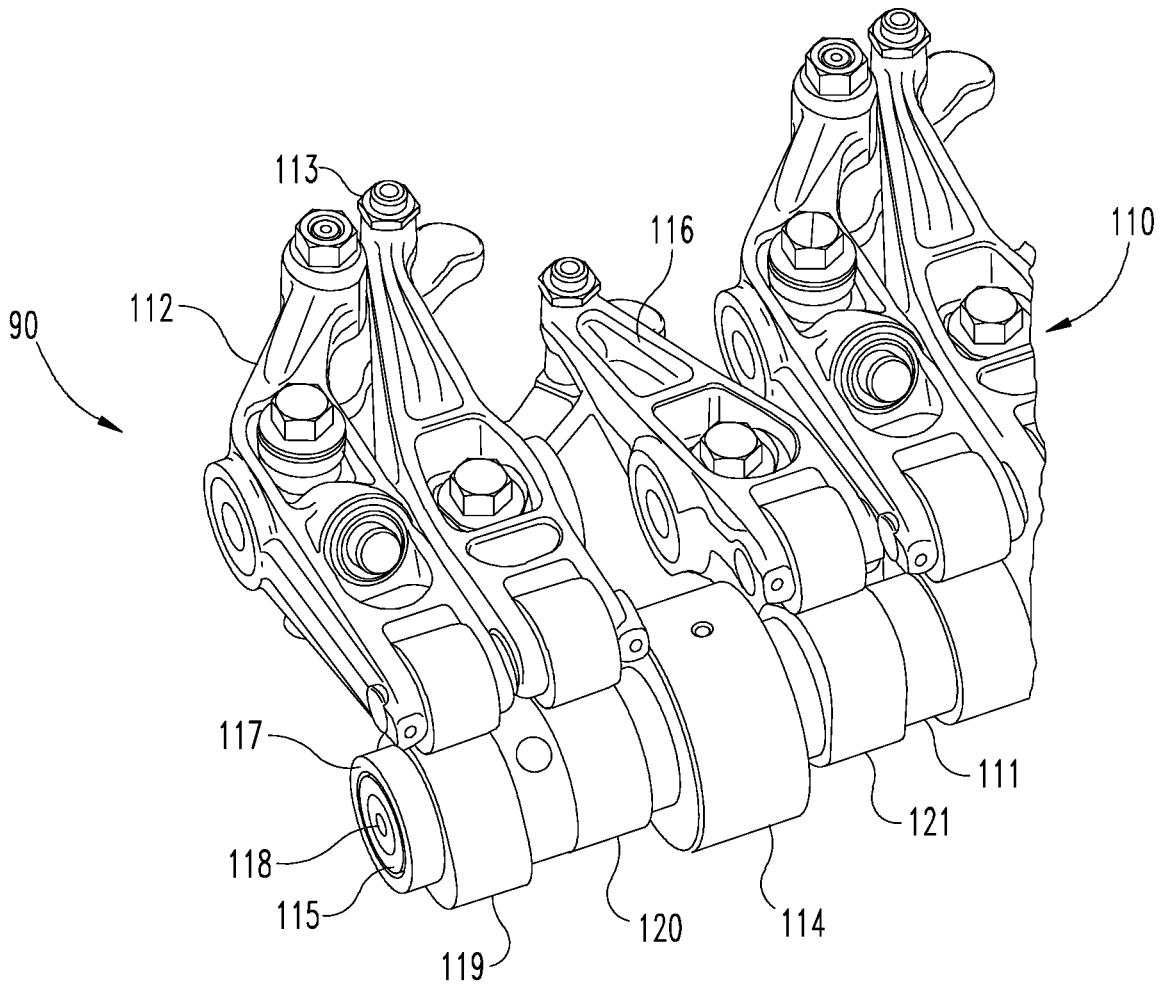
FIG. 3 is a perspective view showing a part of a valve train of the internal combustion engine with dedicated compression brake cam lobes for variable valve actuation.
Figure 4:
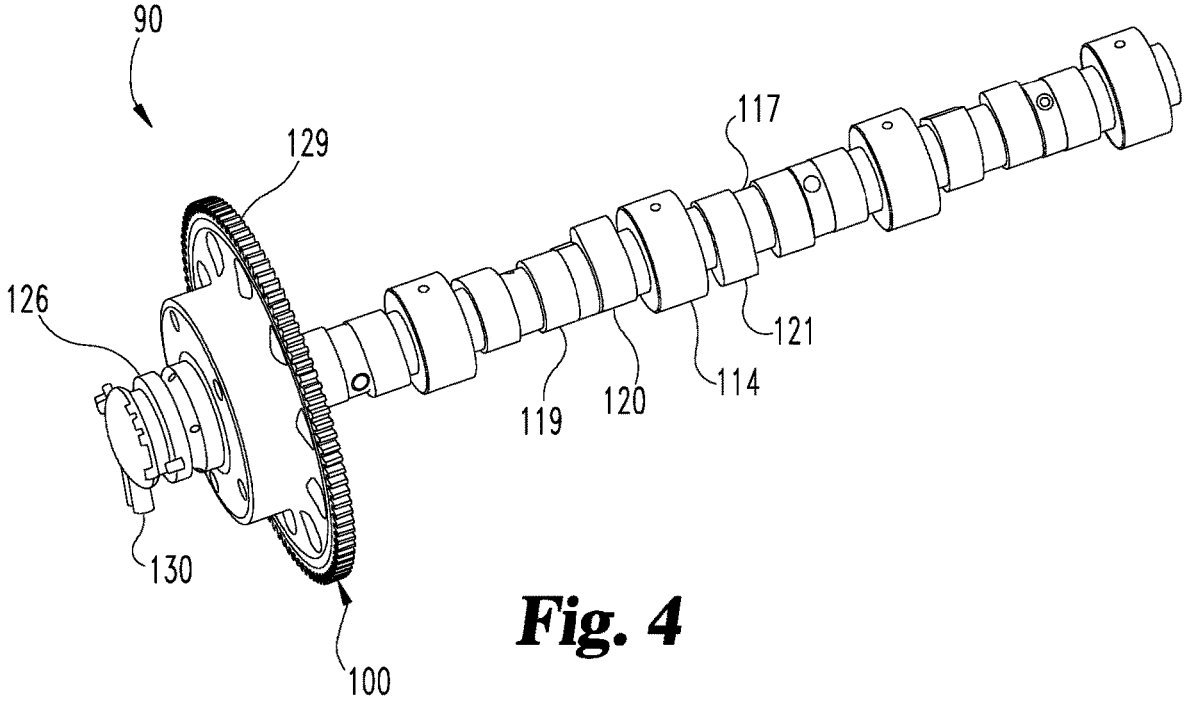
FIG. 4 is a perspective view of a phaser mechanism connected to the camshaft of the valve train of FIG. 3.

Referring to FIGS. 3-4, further details regarding one embodiment of VVA system 90 is shown that is applicable to compression release braking in conjunction with a VVA technology. Specifically, the VVA system 90 includes compression release brake lobes that are coupled to one of the concentric camshaft tubes. The VVA system 90 can further include a phaser that adjusts a relative positioning and timing of the compression release brake lobes during engine braking operations to provide variable engine braking power.

As depicted in FIG. 3, VVA system 90 includes a valve train assembly 110 that utilizes a concentric camshaft 111 constructed of intake camshaft lobe(s) 121, exhaust camshaft lobe(s) 120, dedicated compression release brake lobe(s) 119, and camshaft bearings 114. The camshaft 111 also includes concentrically arranged tubes including an outer tube 117, an intermediate tube 115, and an inner tube or shaft 118, coupled to respective ones of the intake camshaft lobe(s) 121, the exhaust camshaft lobe(s) 120, and the dedicated compression release brake lobe(s) 119. The intake rocker lever(s) 116 follow the intake camshaft lobe(s) 121, the exhaust rocker lever(s) 113 follow the exhaust camshaft lobe 120, and the compression release brake lever(s) 112 follow the dedicated compression release brake lobe(s) 119. The rocker levers 116, 113, 111 actuate the intake and exhaust valves 22, 24 accordingly.

As shown in FIG. 4, an exhaust camshaft phaser 100 is used to control the phase angle of the exhaust camshaft lobes(s) 120 independently of the intake camshaft lobe(s) 121 and the dedicated compression release brake lobe(s) 119. The dedicated compression release brake lobe(s) 119 are also phased independently of the intake camshaft lobe(s) 121 and the exhaust camshaft lobe(s) 120 using the phaser 100. The intake camshaft lobe(s) 121 are not phased and remain in sync with the engine's traditional camshaft drive mechanism. Described another way, the outer tube 117 is at a fixed and constant phase angle with the engine's traditional camshaft drive mechanism while the inner tube or shaft 118 and intermediate tube 115 can vary in phase angle with respect to the engine's traditional camshaft drive mechanism.

Camshaft phaser 100 further includes a front camshaft bearing 126 and a first actuator 130 that is configured to adjust a phase angle of the exhaust camshaft lobe(s) 120 and/or of compression release brake lobe(s) 119. A phase angle of the intake camshaft lobe 121 can also adjusted with a second actuator in another embodiment (not shown.) A concentric camshaft drive gear 129 is connected to the engine crankshaft 18 (FIG. 2) and is driven at a specified and constant drive ratio. The concentric camshaft drive gear 129 also serves as the housing for the vane plates of the exhaust camshaft phaser, the intake camshaft phaser, and the compression release brake phaser.

Camshaft phaser 100 can be used on the shaft or tube 118 that connects to the dedicated compression release brake lobe(s) 119. During a compression release braking mode of operation, the first actuator 130 is configured to selectively and continuously vary the phase angle of the compression release brake lobe(s) 119 to vary the timing at which the compression release brake lobe(s) 119 open the exhaust valve(s) 24 on demand during the compression stroke of the piston 16.

Figure 5:
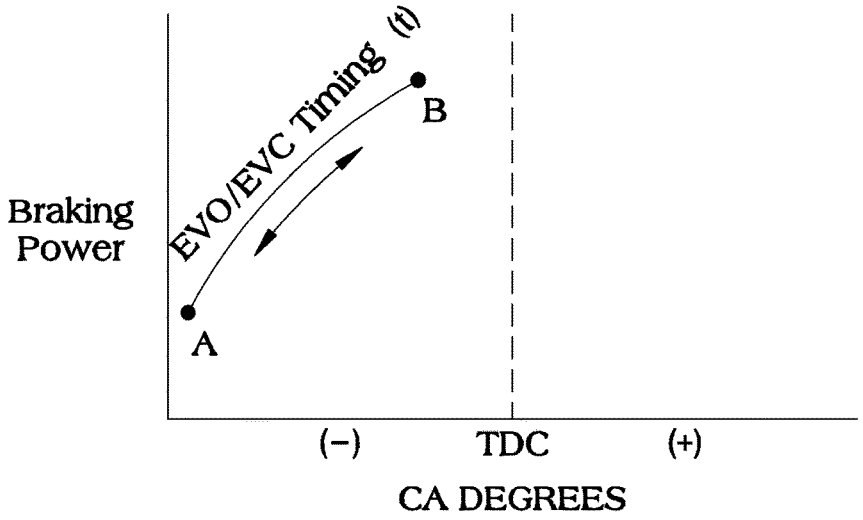
FIG. 5 is a graph showing a relationship between braking power and exhaust valve opening/closing timing relative to top dead center of a compression stroke.

For example, referring to FIG. 5 there is shown a graph that is indicative of the engine braking power that is obtainable relative to opening (EVO) and/or closing (EVC) of the exhaust valve(s) 24 relative to top dead center of a compression stroke of piston 16. Generally, the exhaust braking power increases as the exhaust valve opening or closing occurs closer to top dead center. Thus, by varying the phase angle of camshaft or tube 118 during engine braking using phaser 100, the engine braking power amount that is applied to engine 12 can be varied. In one embodiment, the engine braking power is ramped up and/or ramped down during engine braking at a controlled rate by continuously varying the exhaust valve opening and/or closing timing relative to top dead center between a minimum and maximum desired power to meet a vehicle or engine speed request by increasing a fuelling amount to the cylinder(s) 14. This increases the thermal output from engine 12 and can be used to provide thermal management of, for example, engine 12 and/or aftertreatment system 52. The ramping of the engine braking power that is applied by modulation of the exhaust valve opening or closing can be performed on one of the cylinders 14, all of the cylinders 14, or a subset of the cylinders 14.

Figure 6:
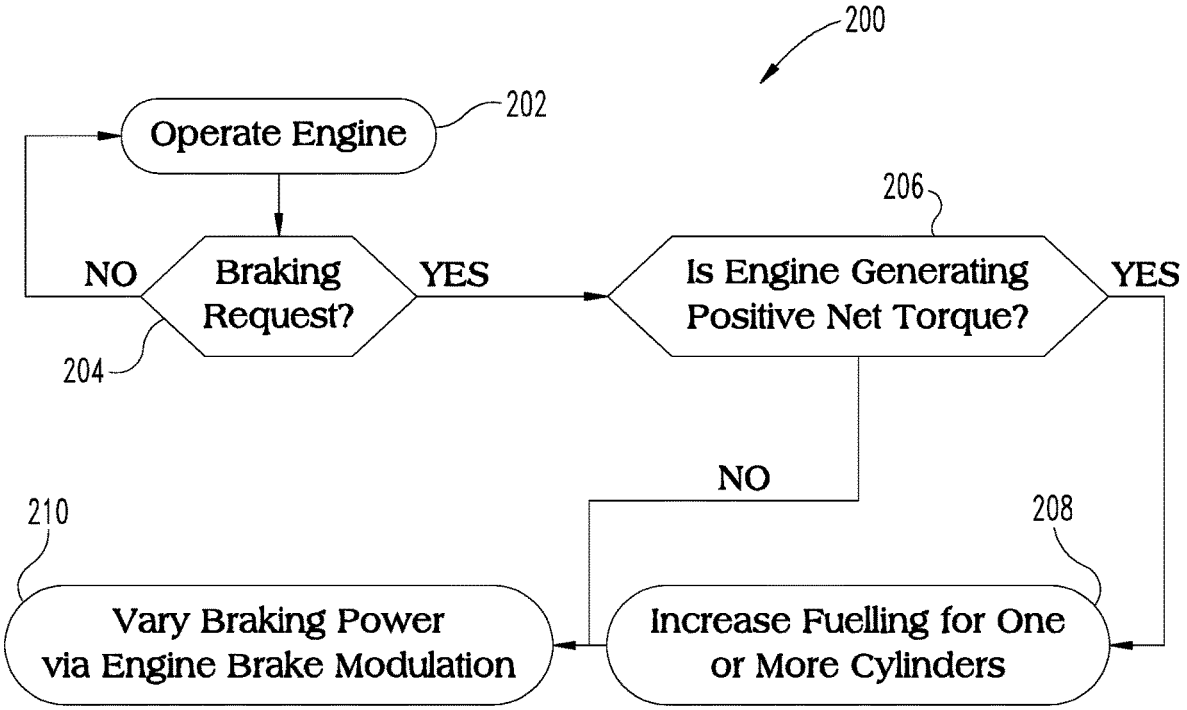
FIG. 6 is a flow diagram of one embodiment of a procedure including variable engine braking for thermal management.

Referring to FIG. 6, a flow diagram of one embodiment of a procedure 200 for engine braking to provide thermal management of one or more of engine 12, aftertreatment device 52, or other component of internal combustion engine system 10 is provided. The procedure 200 includes an operation 202 that includes operating the internal combustion engine system 10 including internal combustion engine 12 with a plurality of cylinders 14 that receive a charge flow from intake passage 36. Furthermore, at least a portion of the plurality of cylinders 14 receives fuel from fuel system 30 in response to a vehicle or engine speed request. In one embodiment of procedure 200, fuelling is cut off from a portion of the cylinders 14.

Procedure 200 continues at conditional 204 to determine the presence or absence of an engine braking request. The determination of the engine braking request being present can result from, for example, an input from a vehicle operator such as a brake pedal position, accelerator pedal position, or engine brake request input switch. The engine braking request can also include or alternatively be a determination that one or more components of the aftertreatment system 52 and/or turbine **40*b* (such as the turbine outlet) is less than a threshold temperature. If conditional 204 is negative procedure 200 returns to operation 202**.

In response to conditional 204 determining an engine braking request being present, procedure 200 can continue at conditional 206 to determine if the engine 12 is generating positive net torque output. If conditional 206 is positive procedure 200 continues at operation 208 to increase fuelling to one or more of the plurality of cylinders 14 to satisfy the vehicle or engine speed request with engine 12. From operation 208, or if conditional 206 is negative, procedure 200 continues at operation 210 to vary a braking power at a given speed of the engine 12 by modulating a timing of at least one of an exhaust valve opening and an exhaust valve closing of one or more of the plurality of cylinders 14 relative to top dead center of the compression stroke of piston 16 in the one or more cylinders 14. The engine braking increases a thermal output of the engine 12 which provides thermal management of engine 12 and/or aftertreatment system 52. The thermal output can be further increased by increasing the fuelling in response to the positive net torque output of the engine during the engine braking event.

In one embodiment of the method 200, the operation 210 includes varying the braking power by operating the camshaft phaser 100 connected to the engine brake camshaft lobe 119 to advance and retard the opening/closing of exhaust valve 24 relative to top dead center of the compression stroke, such as shown in FIG. 5. In another embodiment, varying the braking power of the engine 12 includes modulating the timing of the exhaust valve opening of the one or more of the plurality of cylinders 14 relative to top dead center of the compression stroke of the piston 16 in the one or more cylinders 14. In certain embodiment, the engine braking is performed on all of the cylinders 14, on one cylinder 14, or one a subset of one or more of the cylinders 14. Furthermore, fuelling of the cylinders 14 during the engine braking event can be performed for all the cylinders 14, or a subset of one of more of the cylinders 14, in which case fuelling is cut off from the other cylinders 14.

For example, in FIG. 5 there is shown a relationship that the engine braking power is increased as the opening/closing of the exhaust valve approaches top dead center of the compression stroke of the piston. Gradually advancing the timing (t) of the exhaust valve opening/closing during the engine braking event can be used to ramp up the engine braking power at a controlled ramp rate. Conversely, gradually retarding the timing (t) of the exhaust valve opening can be used to ramp down the engine braking power that is applied at a controlled ramp rate. Thus, the engine braking power can be continuously varied between a minimum braking power A and a maximum braking power B.

During operation of the internal combustion engine system 10, the controller 80 can receive information from the various sensors listed above through I/O interface(s), process the received information using a processor based on an algorithm stored in a memory of the controller 80, and then send command signals to the various actuators through the I/O interface. For example, the controller 80 can receive information regarding an engine braking request, a vehicle or engine speed request, and/or one or more temperature inputs regarding a thermal management condition. The controller 80 is configured to process the requests and/or temperature input(s), and then based on the control strategy, such as procedure 200 discussed above, send one or more command signals to one or more actuators to vary an engine braking power that is applied by modulating an opening/closing timing of the exhaust valve(s) 24 using the associated engine braking cam lobes 119. The control procedure and output can achieve a target thermal management condition of, for example, an inlet/outlet temperature of turbine 40*b* or aftertreatment device 52.

The controller 80 can be configured to implement the disclosed combustion and thermal management strategies using VVA system 90 and fuel system 30. In one embodiment, the disclosed method and/or controller configuration include the controller 80 providing an engine braking command in response to an engine braking request that is based on one or more signals from one or more of the plurality of sensors described above for internal combustion engine system 10. The engine braking command controls VVA mechanism 90 to vary a braking power of the engine 12 at a given engine speed by modulating a timing of at least one of an exhaust valve opening and an exhaust valve closing during a compression stroke of the piston(s) 16 of engine 12.

In one embodiment, the engine braking command from controller 80 varies the braking power by modulating a timing of the exhaust valve opening of exhaust valve(s) 24 relative to top dead center of the compression stoke of piston(s) 16. In another embodiment, the controller 80 is configured to provide the engine braking command with one or more of the plurality of sensors indicating the engine 12 is generating a net positive torque. The controller 80 can also be configured to provide the engine braking command and increase fuelling to one or more of the plurality of cylinders 14 while the engine 12 is generating a net positive torque to satisfy at least one of a vehicle speed request and an engine speed request. Controller 80 can also be configured to provide an engine braking command that ramps the engine braking power up or down with a controlled ramp rate by continuously varying the timing of the at least one of the exhaust valve opening and the exhaust valve closing relative to top dead center of the compression stroke.

The control procedures implemented by the controller 80 can be executed by a processor of controller 80 executing program instructions (algorithms) stored in the memory of the controller 80. The descriptions herein can be implemented with internal combustion engine system 10. In certain embodiments, the internal combustion engine system 10 further includes a controller 80 structured or configured to perform certain operations to control internal combustion engine system 10 in achieving one or more target conditions. In certain embodiments, the controller forms a portion of a processing subsystem including one or more computing devices having memory, processing, and communication hardware. The controller may be a single device or a distributed device, and the functions of the controller 80 may be performed by hardware and/or by instructions encoded on a computer readable medium.

In certain embodiments, the controller 80 includes one or more modules structured to functionally execute the operations of the controller. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on a non-transient computer readable storage medium, and modules may be distributed across various hardware or other computer components.

Certain operations described herein include operations to interpret or determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a non-transient computer readable storage medium, receiving the value as a run-time parameter by any means known in the art, and/or by receiving a value by which the interpreted or determined parameter can be calculated, and/or by referencing a default value that is interpreted or determined to be the parameter value.

Various aspects of the present disclosure are contemplated. According to one aspect, a method includes operating an internal combustion engine system including an internal combustion engine with a plurality of cylinders that receive a charge flow from an intake system, the internal combustion engine system further including an exhaust system for receiving exhaust gas produced by combustion of a fuel provided to at least a portion of the plurality of cylinders from a fuelling system, and at least one of a turbine and an aftertreatment device in the exhaust system; and, in response to an engine braking condition associated with the internal combustion engine, varying a braking power at a given speed of the internal combustion engine by modulating a timing of at least one of an exhaust valve opening and an exhaust valve closing of one or more of the plurality of cylinders relative to top dead center of a compression stroke of a piston in the one or more cylinders to increase a thermal output of the engine.

According to one embodiment, varying the braking power includes operating a phaser connected to an engine brake cam lobe to advance and retard the exhaust valve opening relative to top dead center of the compression stroke via the engine brake cam lobe. In a refinement of this embodiment, the phaser is connected to the engine brake cam lobe with a camshaft.

In another embodiment, the method includes determining the internal combustion engine is generating a positive net torque and increasing a fuelling amount to one or more of the plurality of cylinders while varying the braking power in response to the engine braking condition while the internal combustion engine is generating the positive net torque. In a refinement of this embodiment, the fuelling amount is increased to satisfy at least one of a vehicle speed request and an engine speed request.

In another embodiment, varying the braking power of the internal combustion engine includes modulating the timing of the exhaust valve opening of the one or more of the plurality of cylinders relative to top dead center of the compression stroke of the piston in the one or more cylinders. In yet another embodiment, the braking power is continuously varied between a minimum braking power and a maximum braking power.

In still another embodiment, varying the braking power of the internal combustion engine includes modulating a timing of the at least one of the exhaust valve opening and the exhaust valve closing in each of the plurality of cylinders relative to top dead center of the compression stroke of the piston in each of the one or more cylinders. In another embodiment, varying the braking power includes ramping the braking power up or down with a controlled ramp rate by continuously varying the timing of the at least one of the exhaust valve opening and the exhaust valve closing relative to top dead center of the compression stroke.

In another aspect, a system includes an internal combustion engine including a plurality of cylinders that receive a charge flow from an intake system, an exhaust system for receiving exhaust gas produced by combustion of a fuel provided to at least a portion of the plurality of cylinders from a fuelling system, and at least one of a turbine and an aftertreatment device in the exhaust system. The system also includes a plurality of sensors operable to provide signals indicating operating conditions of the system and a variable valve actuation mechanism configured to control an opening and closing timing of exhaust valves associated with the plurality of cylinders. The system further includes a controller connected to the plurality of sensors operable to interpret one or more signals from the plurality of sensors. The controller, in response to an engine braking request based on the one or more signals, is configured to control the variable valve actuation mechanism to vary a braking power of the internal combustion engine at a given engine speed by modulating a timing of at least one of an exhaust valve opening and an exhaust valve closing of one or more of the plurality of cylinders relative to top dead center of a compression stroke of a piston in the one or more cylinders.

In one embodiment, the variable valve actuation mechanism includes a phaser connected to a dedicated engine brake cam lobe. In a refinement of this embodiment, the variable valve actuation mechanism is connected to the dedicated engine brake cam lobe with a camshaft.

In another embodiment, the controller is configured to increase a fuelling of one or more of the plurality of cylinders to meet one of a vehicle speed request and an engine speed request while modulating the timing of the at least one of the exhaust valve opening and the exhaust valve closing. In a refinement of this embodiment, the controller is configured to determine the internal combustion engine is generating a positive net torque and to increase fuelling and modulate the timing of the least one of the exhaust valve opening and the exhaust valve closing while the internal combustion engine is generating the positive net torque.

In another embodiment, the controller is configured to vary the braking power by ramping the braking power up or down with a controlled ramp rate by continuously varying the timing of the at least one of the exhaust valve opening and the exhaust valve closing relative to top dead center of the compression stroke.

In yet another aspect of the present disclosure, an apparatus includes a controller for connection to a plurality of sensors configured to interpret signals from the plurality of sensors associated with operation of an internal combustion engine. The controller is further configured to provide an engine braking command to vary a braking power of the internal combustion engine at a given engine speed by modulating a timing of at least one of an exhaust valve opening and an exhaust valve closing during a compression stroke of the internal combustion engine in response to an engine braking request that is based on one or more signals from one or more of the plurality of sensors.

In one embodiment, the engine braking command varies the braking power by modulating a timing of the exhaust valve opening relative to top dead center of the compression stoke. In another embodiment, the controller is configured to provide the engine braking command with one or more of the plurality of sensors indicating the internal combustion engine is generating a net positive torque. In a refinement of this embodiment, the controller is configured to provide the engine braking command and increase fuelling to one or more of the plurality of cylinders while the internal combustion engine is generating the net positive torque to satisfy at least one of a vehicle speed request and an engine speed request.

In another embodiment, the controller is further configured to ramp the braking power up or down with a controlled ramp rate by continuously varying the timing of the at least one of the exhaust valve opening and the exhaust valve closing relative to top dead center of the compression stroke.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

operating an internal combustion engine system including an internal combustion engine with a plurality of cylinders that receive a charge flow from an intake system, the internal combustion engine system further including an exhaust system for receiving exhaust gas produced by combustion of a fuel provided to at least a portion of the plurality of cylinders from a fuelling system, and at least one of a turbine and an aftertreatment device in the exhaust system; and in response to an engine braking condition associated with the internal combustion engine, varying a braking power at a given speed of the internal combustion engine by modulating a timing of at least one of an exhaust valve opening and an exhaust valve closing of one or more of the plurality of cylinders relative to top dead center of a compression stroke of a piston in the one or more cylinders to increase a thermal output of the engine.

2. The method of claim 1, wherein varying the braking power includes operating a phaser connected to an engine brake cam lobe to advance and retard the exhaust valve opening relative to top dead center of the compression stroke via the engine brake cam lobe.

3. The method of claim 2, wherein the phaser is connected to the engine brake cam lobe with a camshaft.

4. The method of claim 1, wherein the engine braking condition includes a thermal management condition and, in response to the thermal management condition, further comprising:

determining the internal combustion engine is generating a positive net torque; and increasing a fuelling amount to one or more of the plurality of cylinders while varying the braking power in response to the engine braking condition while the internal combustion engine is generating the positive net torque.

5. The method of claim 4, wherein the fuelling amount is increased to satisfy at least one of a vehicle speed request and an engine speed request.

6. The method of claim 1, wherein varying the braking power of the internal combustion engine includes modulating the timing of the exhaust valve opening of the one or more of the plurality of cylinders relative to top dead center of the compression stroke of the piston in the one or more cylinders.

7. The method of claim 1, wherein the braking power is continuously varied between a minimum braking power and a maximum braking power.

8. The method of claim 1, wherein varying the braking power of the internal combustion engine includes modulating a timing of the at least one of the exhaust valve opening and the exhaust valve closing in each of the plurality of cylinders relative to top dead center of the compression stroke of the piston in each of the one or more cylinders.

9. The method of claim 1, wherein varying the braking power includes ramping the braking power up or down with a controlled ramp rate by continuously varying the timing of the at least one of the exhaust valve opening and the exhaust valve closing relative to top dead center of the compression stroke.

10. A system, comprising:

an internal combustion engine including a plurality of cylinders that receive a charge flow from an intake system, an exhaust system for receiving exhaust gas produced by combustion of a fuel provided to at least a portion of the plurality of cylinders from a fuelling system, and at least one of a turbine and an aftertreatment device in the exhaust system;

a plurality of sensors operable to provide signals indicating operating conditions of the system;

a variable valve actuation mechanism configured to control an opening and closing timing of exhaust valves associated with the plurality of cylinders; and a controller connected to the plurality of sensors operable to interpret one or more signals from the plurality of sensors, wherein the controller, in response to an engine braking request based on the one or more signals, is configured to control the variable valve actuation mechanism to vary a braking power of the internal combustion engine at a given engine speed by modulating a timing of at least one of an exhaust valve opening and an exhaust valve closing of one or more of the plurality of cylinders relative to top dead center of a compression stroke of a piston in the one or more cylinders.

11. The system of claim 10, wherein the variable valve actuation mechanism includes a phaser connected to a dedicated engine brake cam lobe.

12. The system of claim 11, wherein the variable valve actuation mechanism is connected to the dedicated engine brake cam lobe with a camshaft.

13. The system of claim 10, wherein the engine braking request is determined at least in part in response to a thermal management condition and the controller is configured to increase a fuelling of one or more of the plurality of cylinders to meet one of a vehicle speed request and an engine speed request while modulating the timing of the at least one of the exhaust valve opening and the exhaust valve closing to increase a thermal output of the internal combustion engine.

14. The system of claim 13, wherein the controller is configured to determine the internal combustion engine is generating a positive net torque and to increase fuelling and modulate the timing of the least one of the exhaust valve opening and the exhaust valve closing while the internal combustion engine is generating the positive net torque.

15. The system of claim 10, wherein the controller is configured to vary the braking power by ramping the braking power up or down with a controlled ramp rate by continuously varying the timing of the at least one of the exhaust valve opening and the exhaust valve closing relative to top dead center of the compression stroke.

16. An apparatus, comprising:

a controller for connection to a plurality of sensors configured to interpret signals from the plurality of sensors associated with operation of an internal combustion engine, wherein the controller is further configured to provide an engine braking command to vary a braking power of the internal combustion engine at a given engine speed by modulating a timing of at least one of an exhaust valve opening and an exhaust valve closing during a compression stroke of the internal combustion engine in response to an engine braking request that is based on one or more signals from one or more of the plurality of sensors.

17. The apparatus of claim 16, wherein the engine braking command varies the braking power by modulating a timing of the exhaust valve opening relative to top dead center of the compression stoke.

18. The apparatus of claim 16, wherein the engine braking request is determined at least in part in response to a thermal management condition and the controller is configured to provide the engine braking command with one or more of the plurality of sensors indicating the internal combustion engine is generating a net positive torque to increase a thermal output of the internal combustion engine.

19. The apparatus of claim 18, wherein the controller is configured to provide the engine braking command and increase fuelling to one or more of the plurality of cylinders while the internal combustion engine is generating the net positive torque to satisfy at least one of a vehicle speed request and an engine speed request.

20. The apparatus of claim 16, wherein the controller is further configured to ramp the braking power up or down with a controlled ramp rate by continuously varying the timing of the at least one of the exhaust valve opening and the exhaust valve closing relative to top dead center of the compression stroke.

* * * * *